US005904410A

United States Patent [19]

Davies

[11] Patent Number: 5,904,410

[45] Date of Patent: May 18, 1999

[54] MODEL FURNITURE SYSTEM

[76] Inventor: Gerald D. Davies, 6575 Cornelia Cir., Buena Park, Calif. 90620

[21] Appl. No.: 09/061,217

[22] Filed: Apr. 16, 1998

[51] Int. Cl.[6] ..... A47B 43/00

[52] U.S. Cl. ..... 312/259; 312/258; 312/204; 248/174; 297/440.12; 297/440.13; 446/478; 446/488; 40/539

[58] Field of Search ..... 312/204, 258, 312/259, 234, 6; 446/478, 482, 487, 488; 40/124.14, 312, 538, 539; 297/440.12, 440.13; 248/174

[56] References Cited

U.S. PATENT DOCUMENTS

| | | | |
|---|---|---|---|
| 513,688 | 1/1894 | Smith | 446/478 |
| 2,054,915 | 9/1936 | Stern | 248/174 X |
| 2,232,953 | 2/1941 | Mallgraf | 446/488 |
| 2,810,474 | 10/1957 | Essick | 40/312 |
| 3,425,764 | 2/1969 | Budd | 312/259 |
| 3,566,808 | 3/1971 | Slats, Jr. | 297/440.13 X |
| 4,102,525 | 7/1978 | Albano | 248/174 |
| 4,261,627 | 4/1981 | Felsenthal | 312/258 |
| 4,267,998 | 5/1981 | Weirich | 248/174 X |
| 4,463,997 | 8/1984 | Densen | 312/259 |
| 4,765,006 | 8/1988 | Jackson et al. | 446/488 X |
| 4,825,572 | 5/1989 | Altman Robbins et al. | 40/539 |

FOREIGN PATENT DOCUMENTS

| | | | |
|---|---|---|---|
| 145281 | 4/1936 | Germany | 40/539 |
| 2503342 | 7/1976 | Germany | 446/478 |
| 209970 | 1/1924 | United Kingdom | 446/488 |
| 410818 | 5/1934 | United Kingdom | 446/488 |
| 2126113 | 3/1984 | United Kingdom | 446/488 |

*Primary Examiner*—Peter M. Cuomo
*Assistant Examiner*—James O. Hansen

[57] ABSTRACT

A furniture model system is provided including at least one model furniture piece having a three dimensional rectilinear configuration and a picture on each of the faces thereof which simulate an associated view of a related furniture piece.

3 Claims, 2 Drawing Sheets

MODEL FURNITURE SYSTEM

BACKGROUND OF THE INVENTION

1. Field of the Invention

The present invention relates to model structures and more particularly pertains to a new model furniture system for simulating an inhabited home.

2. Description of the Prior Art

The use of model structures is known in the prior art. More specifically, model structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art model structures include U.S. Pat. No. 4,696,652; U.S. Pat. No. 1,881,356; U.S. Pat. No. 4,261,627; U.S. Pat. No. 3,498,587; U.S. Pat. No. 5,265,848; and Foreign Patents WO 96/11604 & WO 97/00039.

In these respects, the model furniture system according to the present invention substantially departs from the conventional concepts and designs of the prior art, and in so doing provides an apparatus primarily developed for the purpose of simulating an inhabited home.

SUMMARY OF THE INVENTION

In view of the foregoing disadvantages inherent in the known types of model structures now present in the prior art, the present invention provides a new model furniture system construction wherein the same can be utilized for simulating an inhabited home.

The general purpose of the present invention, which will be described subsequently in greater detail, is to provide a new model furniture system apparatus and method which has many of the advantages of the model structures mentioned heretofore and many novel features that result in a new model furniture system which is not anticipated, rendered obvious, suggested, or even implied by any of the prior art model structures, either alone or in any combination thereof.

To attain this, the present invention generally comprises a plurality of model furniture pieces each constructed from a cardboard material. The pieces each include a plurality of faces having a planar rectangular configuration. Such faces include a front face with a photograph of a front of a piece of furniture adhered thereon. The front face further has a periphery defined by a top edge, a bottom edge and a pair of side edges. The faces of each furniture piece further include a pair of side faces each having a photograph of a side of the piece of furniture adhered thereon. A first side edge of each side face is integrally coupled to one of the side edges of the front face to define a fold therebetween. A rear face of each furniture piece is equipped with a photograph of a rear of a piece of furniture adhered thereon. A side edge of the rear face is integrally coupled to a second side edge of one of the side faces to define a fold therebetween. Finally, the faces of each furniture piece include a top face and a bottom face having a photograph of a top and bottom of the piece of furniture, respectively, adhered thereon. The top and bottom face each further have a first edge integrally coupled to the top and bottom edges of the front face, respectively. The furniture pieces each further include three thin lips integrally coupled to second edges of the top and bottom face and a second edge of one of the side faces. As shown in FIG. 3, the lips extend from the associated face in perpendicular relationship therewith. Each lip has a pile fastener mounted on an outer surface thereof for releasably coupling with a pile fastener lining a periphery of an interior surface of the rear face of the furniture piece. By this structure, the furniture piece is maintained in a three dimensional rectangular configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new model furniture system apparatus and method which has many of the advantages of the model structures mentioned heretofore and many novel features that result in a new model furniture system which is not anticipated, rendered obvious, suggested, or even implied by any of the prior art model structures, either alone or in any combination thereof.

It is another object of the present invention to provide a new model furniture system which may be easily and efficiently manufactured and marketed.

It is a further object of the present invention to provide a new model furniture system which is of a durable and reliable construction.

An even further object of the present invention is to provide a new model furniture system which is susceptible of a low cost of manufacture with regard to both materials and labor, and which accordingly is then susceptible of low prices of sale to the consuming public, thereby making such model furniture system economically available to the buying public.

Still yet another object of the present invention is to provide a new model furniture system which provides in the apparatuses and methods of the prior art some of the advantages thereof, while simultaneously overcoming some of the disadvantages normally associated therewith.

Still another object of the present invention is to provide a new model furniture system for simulating an inhabited home.

Even still another object of the present invention is to provide a new model furniture system that includes at least one model furniture piece having a three dimensional rectilinear configuration and a picture on each of the faces thereof which simulate an associated view of a related furniture piece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
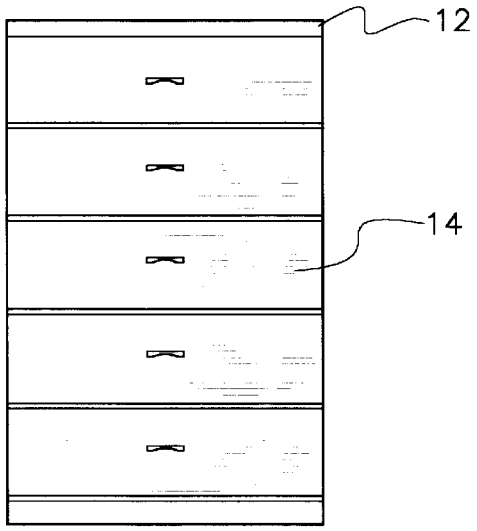
FIG. 1 is a front view of one of the furniture pieces of the present invention which takes the form of a dresser.
Figure 2:
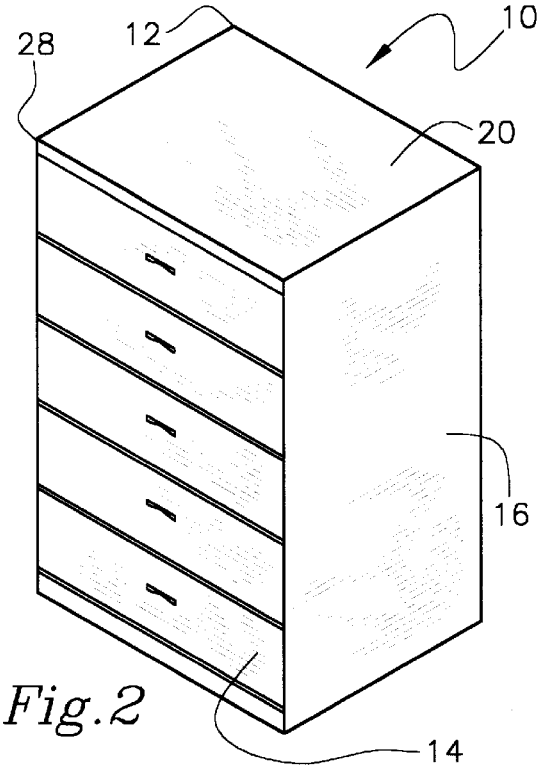
FIG. 2 is a perspective view of the furniture piece shown in FIG. 1.

With reference now to the drawings, and in particular to FIGS. 1 through 7 thereof, a new model furniture system embodying the principles and concepts of the present invention and generally designated by the reference numeral 10 will be described.

The present invention, designated as numeral 10, includes a plurality of model furniture pieces 12 each constructed from a cardboard material. The pieces each include a plurality of faces having a planar rectangular configuration. Such faces include a front face 14 with a photograph 15 of a front of a piece of furniture adhered thereon. The front face further has a periphery defined by a top edge, a bottom edge and a pair of side edges.

The faces of each furniture piece further include a pair of side faces 16 each having a photograph of a side of the piece of furniture adhered thereon. A first side edge of each side face is integrally coupled to one of the side edges of the front face to define a fold, or living hinge, therebetween. A rear face 18 of each furniture piece is equipped with a photograph of a rear of the piece of furniture adhered thereon. A side edge of the rear face is integrally coupled to a second side edge of one of the side faces to define a fold therebetween.

Finally, the faces of each furniture piece include a top face 20 and a bottom face 22 having a photograph of a top and bottom of the piece of furniture, respectively, adhered thereon. The top and bottom face each further have a first edge integrally coupled to the top and bottom edges of the front face, respectively.

Figure 3:
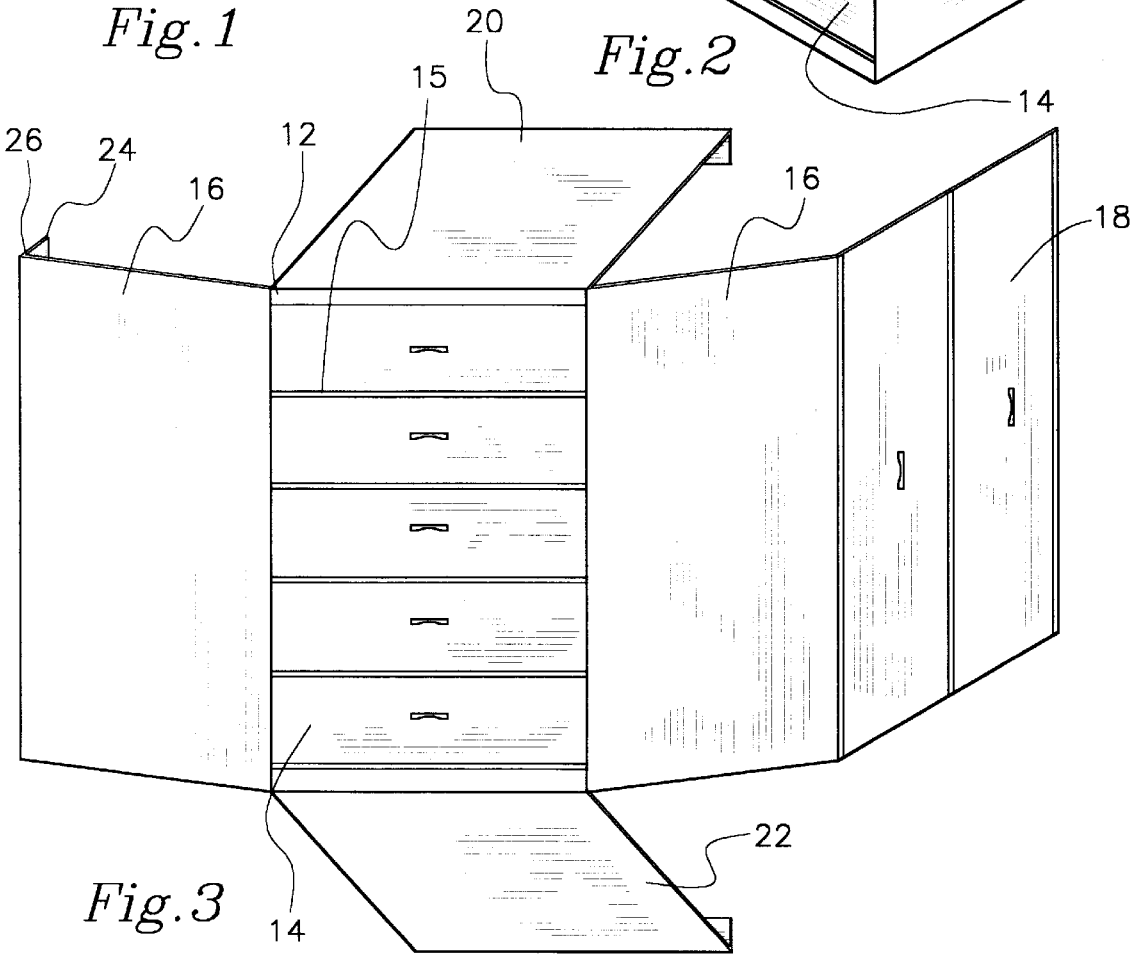
FIG. 3 is an exploded view of the present invention.
Figure 4:
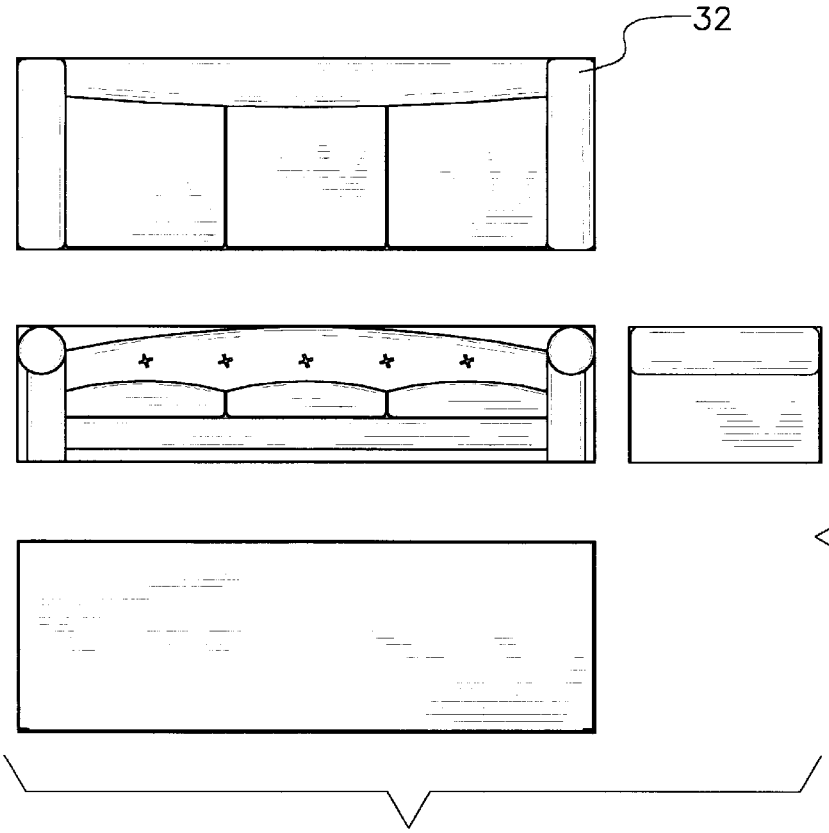
FIG. 4 is a multi-perspective view of the model couch of the present invention.

The furniture pieces each further include three thin lips 24 integrally coupled to second edges of the top and bottom face and a second edge of one of the side faces. As shown in FIG. 3, the lips extend from the associated face in perpendicular relationship therewith. Each lip has a pile fastener 26 mounted on an outer surface thereof for releasably coupling with a pile fastener lining a periphery of an interior surface of the rear face of the furniture piece. By this structure, the furniture piece is maintained in a three dimensional rectangular configuration.

As shown in FIGS. 1, 4, 6 & 7, the furniture pieces include a model dresser 28 with a height greater than its width and depth. Also included is a model bed 30 with a height and width less than a depth thereof. A model couch 32 is provided with a depth and a height less than a width thereof. Lastly, a model chair 34 is equipped with a cubical configuration. It should be noted that the pieces of furniture may take the form of any chair, table, appliance or other similar structure found in an inhabited home.

Figure 5:
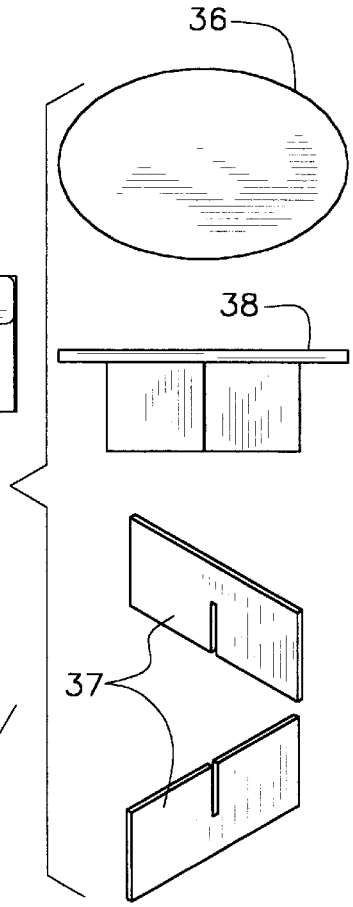
FIG. 5 is an exploded view of the model table of the present invention.
Figure 6:
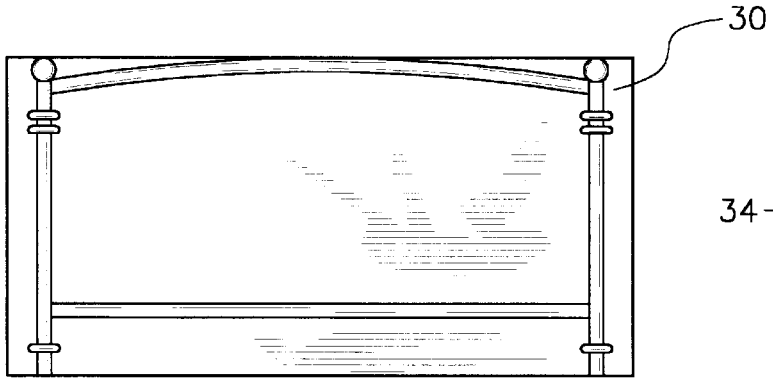
FIG. 6 is a side view of the model bed of the present invention.
Figure 7:
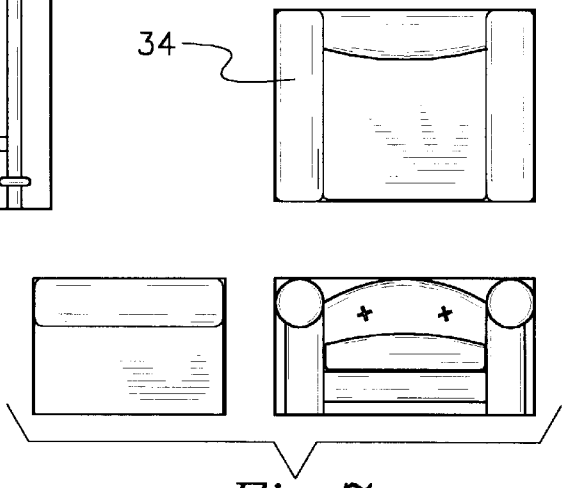
FIG. 7 is a multi-perspective view of the model chair of the present invention.

FIG. 5 shoes a model table 36 including a pair of cardboard plates 37 each having a planar rectangular configuration. Each cardboard plate has a periphery defined by an elongated top edge, an elongated bottom edge and a pair of short side edges formed therebetween. The cardboard pieces include a first plate with a groove formed therein between the top edge and a point spaced from the bottom. Associated therewith is a second plate with a groove formed therein. Such groove of the second plate extends from the bottom edge to a point spaced from the top edge.

The model table further includes a cardboard member 38 with a planar circular configuration. In use, the cardboard plates may be engaged in an X-shaped configuration such that the cardboard member may be situated thereon to simulate a table. In use, each of the pieces of model furniture may be situated within a home or model for simulating an inhabited home. This may be done for the purpose of facilitating the selling of the home.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A furniture model system comprising, in combination:

a plurality of model furniture pieces each constructed from a cardboard material and including a plurality of faces each having a planar rectangular configuration, the faces including a front face with a photograph of a front of a piece of furniture adhered thereon and having a periphery defined by a top edge, a bottom edge and a pair of side edges, the faces further including a pair of side faces each having a photograph of a side of the piece of furniture adhered thereon and having a first side edge integrally coupled to one of the side edges of the front face to define a fold therebetween, a rear face with a photograph of a rear of a piece of furniture adhered thereon and a side edge integrally coupled to a second side edge of one of the side faces to define a fold therebetween, and a top face and a bottom face each having a photograph of a top and bottom of the piece of furniture, respectively, adhered thereon, the top and bottom face each having a first edge integrally coupled to the top and bottom edges of the front face, respectively, the furniture pieces each further including three thin lips integrally coupled to second edges of the top and bottom face and a second edge of one of the side faces with the lips extending therefrom in perpendicular relationship therewith, each lip having a pile fastener mounted on an outer surface thereof for releasably coupling with a pile fastener lining a periphery of an interior surface of the rear face of the furniture piece, thereby maintaining the furniture piece in a three dimensional rectangular configuration;

said furniture pieces including a model dresser with a height greater than its width and depth, a model bed with a height and width less than a depth thereof, a model couch with a depth and a height less than the width thereof, and a model chair with a cubical configuration;

a model table including a pair of cardboard plates each having a planar rectangular configuration and a periphery defined by an elongated top edge, an elongated bottom edge and a pair of short side edges formed therebetween, the cardboard plates including a first plate with a groove formed therein between the top edge and a point spaced from the bottom edge in perpendicular relationship with the top edge and a second plate with a groove formed therein between the bottom edge and a point spaced from the top edge in perpendicular relationship with the bottom edge, the model table further including a cardboard member with a planar circular configuration, wherein the cardboard plates may be engaged in an X-shaped configuration such that the cardboard member may be situated thereon to simulate a table.

2. A furniture model system comprising a model furniture piece constructed from a cardboard material and including a plurality of faces each having a substantially planar rectangular configuration, the faces including a front face with a photograph of a front of a piece of furniture adhered thereon and having a periphery defined by a top edge, a bottom edge and a pair of side edges, the faces further including a pair of side faces each having a photograph of a side of the piece of furniture adhered thereon and having a first side edge integrally coupled to one of the side edges of the front face to define a fold therebetween, a rear face with a photograph of a rear of a piece of furniture adhered thereon and a side edge integrally coupled to a second side edge of one of the side faces to define a fold therebetween, and a top face and a bottom face each having a photograph of a top and bottom of the piece of furniture, respectively, adhered thereon, the top and bottom face each having a first edge integrally coupled to the top and bottom edges of the front face, respectively, the furniture piece further including three thin lips integrally coupled to second edges of the top and bottom face and a second edge of one of the side faces with the lips extending therefrom in perpendicular relationship therewith, each lip having a pile fastener mounted on an outer surface thereof for releasably coupling with a pile fastener lining a periphery of an interior surface of the rear face of the furniture piece, thereby maintaining the furniture piece in a three dimensional rectangular configuration.

3. A furniture model system as set forth in claim 2 wherein said furniture piece includes at least one of a model dresser with a height greater than its width and depth, a model bed with a height and width less than a depth thereof, a model couch with a depth and a height less than the width thereof, and a model chair with a cubical configuration.

* * * * *